United States Patent [19]

Kanzelberger

[11] Patent Number: 4,459,772

[45] Date of Patent: Jul. 17, 1984

[54] DEBOSSABLE PLASTIC PLAQUE WITH FINE JEWELRY APPEARANCE

[75] Inventor: James C. Kanzelberger, Riverside, Ill.

[73] Assignee: Contemporary, Inc., Riverside, Ill.

[21] Appl. No.: 394,527

[22] Filed: Jul. 2, 1982

Related U.S. Application Data

[63] Continuation-in-part of Ser. No. 209,753, Nov. 24, 1980, Pat. No. 4,384,416.

[51] Int. Cl.[3] ..... A47G 1/06

[52] U.S. Cl. ..... 40/152.1; 40/1.5; 40/1.6; 40/154; 156/219; 156/220; 156/233; 427/147; 428/209

[58] Field of Search ..... 428/44, 45, 156, 209; 40/616, 1.5, 1.6, 158 R, 154; 156/219, 220, 233; 427/147

[56] References Cited

U.S. PATENT DOCUMENTS

| | | | |
|---|---|---|---|
| 3,295,235 | 1/1967 | Tauber | 40/1.5 |
| 3,386,199 | 6/1968 | Nagatsuka | 40/158 R |
| 3,506,528 | 4/1970 | Dean | 428/156 |
| 3,540,146 | 11/1970 | Watkins | 40/152.1 |
| 3,956,837 | 5/1976 | Itano | 40/152.1 |
| 4,020,575 | 5/1977 | Kruger et al. | 40/1.5 |
| 4,125,655 | 11/1978 | Kanzelberger | 40/616 |
| 4,183,159 | 1/1980 | Issac | 40/1.6 |
| 4,190,691 | 2/1980 | Kramer | 40/158 R |

*Primary Examiner*—Gene Mancene
*Assistant Examiner*—Cary E. Stone
*Attorney, Agent, or Firm*—Laff, Whitesel, Conte & Saret

[57] ABSTRACT

A sheet of debossable plastic material is bonded to a backing plate, which may be a metal plate preferably pre-formed in a coin die. A polished surface on the edges of the metal plate projects beyond the plastic sheet material. The combined effect of the debossable plastic material, with a brushed metallic appearance, and the backing plate with polished edges greatly enhances an appearance of an engraved metal plate. This basic unit may be used in combination with other structures to form plaques, frames, name badges, and the like. When used in some combinations, such as a picture in a frame of the plastic sheet, for example, the components may be pre-assembled into a complete packet before attachment to a stand.

18 Claims, 10 Drawing Figures

DEBOSSABLE PLASTIC PLAQUE WITH FINE JEWELRY APPEARANCE

This is a continuation-in-part of my co-pending application Ser. No. 209,753, filed Nov. 24, 1980, U.S. Pat. No. 4,384,416.

This invention relates to means for and methods of making plaques having debossed plastic plates, which simulate the appearance of engraved metal plates, and more particularly, to such plaques having the appearance of fine jewelry.

Some aspects of this invention are described in greater detail in one or more of my U.S. Pat. Nos. 3,940,864; 4,047,996; 4,267,224; and 4,125,655 and co-pending applications, Ser. No. 801,863 (filed May 31, 1977), and Ser. No. 209,753 (filed Nov. 24, 1980).

In these patents and applications, I disclose a debossable plastic material comprising a thermoplastic plate which has an upper surface covered by a thin film sheet that follows and contains the debossment of a hot stamping process. This film or sheet may be "Mylar" or a similar polyester film of a thermally insulating material with a metalized surface, that simulates the appearance of brushed metal. The lower surface of the thermoplastic plate is bonded to a substrate that prevents lateral displacement of the thermoplastic material, during the hot stamped debossment. The hot stamping process may press and fuse the ink of a hot stamping foil into the debossment.

One of the above cited patents (U.S. Pat. No. 4,125,655) uses the debossable material in conjunction with a wooden or wood simulating board in order to make a plaque, which is a strikingly realistic simulation of an expensive wooden plaque having an engraved metal plate mounted thereon. However, these plaques are most appropriate for sports awards, or other similar, less formal usage. They are not supposed to have an appearance with the quiet elegance of fine jewelry. The present invention provides that fine jewelry appearance. Of course, the foregoing comments are given merely to highlight the different appearance levels. The plaques of U.S. Pat. No. 4,125,655 may be used any place, including elegant surroundings. Likewise, the plaques described herein may also be used any place, including less formal surroundings.

The plaques of U.S. Pat. No. 4,125,655 mount a somewhat flexible, debossable plastic sheet on a wooden board. Therefore, if any substantial weight is to be added to the plaques, that weight must be attached through the plastic sheet and directly to the wooden backing board. This means that there must be relatively great manufacturing precision to match pre-formed mounting holes in the wood with corresponding holes in the plastic sheet. In such manufacturing, there is a substantial cost.

One of the above identified applications (Ser. No. 209,753) relates to a picture frame (or the like) in which a sheet of debossable material, containing a die cut window, is attached to the front of a transparent stand. A pocket is attached to the back of the stand. A picture or other graphic material is placed between a transparent sheet and a backing sheet having a pressure sensitive adhesive thereon. When the picture is aligned within a target area printed on the transparent sheet, it is pressed against the adhesive to secure it to the backing sheet. Thereafter, the backing sheet, with picture attached, is slipped into the pocket on the back of the transparent stand. The picture or graphic material is viewed through the window and the transparent stand material.

The picture stand of Ser. No. 209,753 is well suited to its intended purpose; however, it lacks the fine jewelry appearance which this invention affords. Also, the separate attachments of the windowed sheet to the front of the stand and of the picture to the backing sheet requires a substantial precision of manufacture and usage. For example, if the window in the debossable material should be displaced, say, an eighth of an inch to the left and the target area on the transparent sheet should be displaced an eighth of an inch to the right, the total misalignment is a quarter inch.

While it may be easy to compensate for this error by correctly positioning the picture on the backing sheet, the total cumulative misalignment may not be discovered until after the picture is cemented to the backing sheet. Then, the picture or other graphic material may be damaged if it must be separated from the backing sheet in order to realign it.

Accordingly, an object of the invention is to provide new and improved frames, plaques, and the like, and especially to frames and plaques using my debossable plastic plates, having a metal-like appearance. Here, an object is to provide an appearance quality which is comparable to the appearance of fine jewelry.

Another object of the invention is to reduce the cost of such frames, plaques, and the like. Here, an object is to eliminate a need for precision assembly. In this connection, an object is to reduce the possibility of damage to pictures and other objects used in connection therewith.

Still another object of the invention is to provide means for applying the principles of the invention to a great variety of different uses.

In keeping with an aspect of the invention, these and other objects are accomplished by bonding the debossable plastic material to a backing plate, which may preferably be a metal plate which is pre-formed in a coin die. A polished surface may be formed on the edges of the metal plate, which project beyond the debossable plastic material. The combined effect of the embossable plastic material, with a brushed metal appearance, and the metal plate with polished edges greatly enhances the illusion that there is an expensive engraved metal plate instead of a relatively low cost hot stamped plastic sheet. The resulting combination of plastic material and plate may be used on or in connection with backing boards, plastic stands, metal plates, or the like to make a great number of different structures and objects. When pictures or other graphics are added, the combination of picture and plastic material may be pre-formed into a packet in order to insure its perfect alignment, at a point where the various parts are easy to manipulate and before the final product is assembled into a difficult to take apart unit.

The invention will become more apparent from the following specification, taken in connection with the attached drawings, in which.

Figure 1:
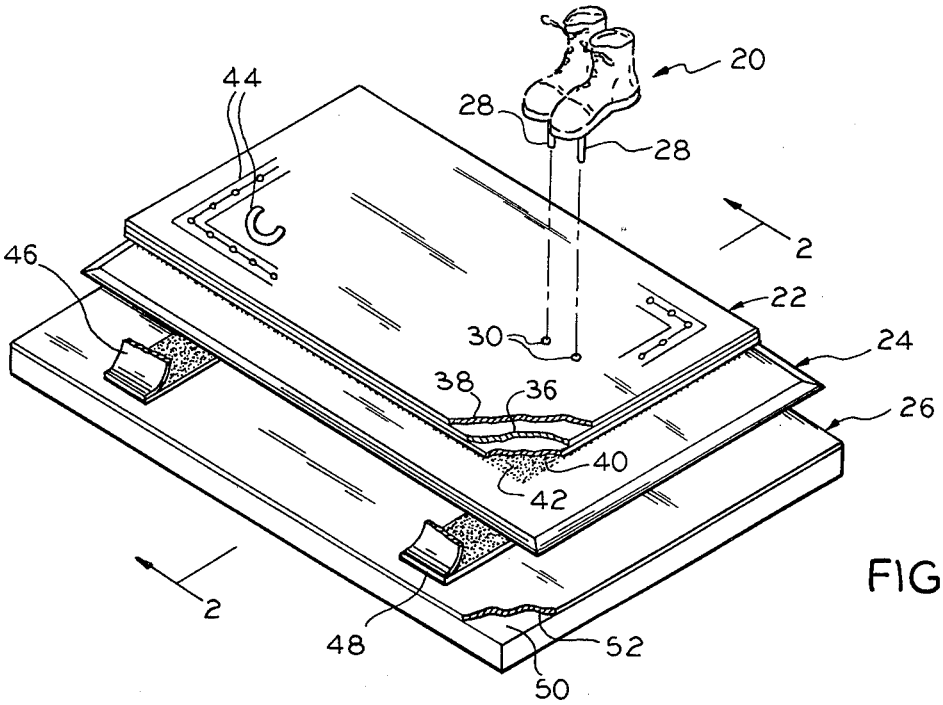
FIG. 1 is an exploded view of the invention, used in connection with an exemplary wooden base.
Figure 2:
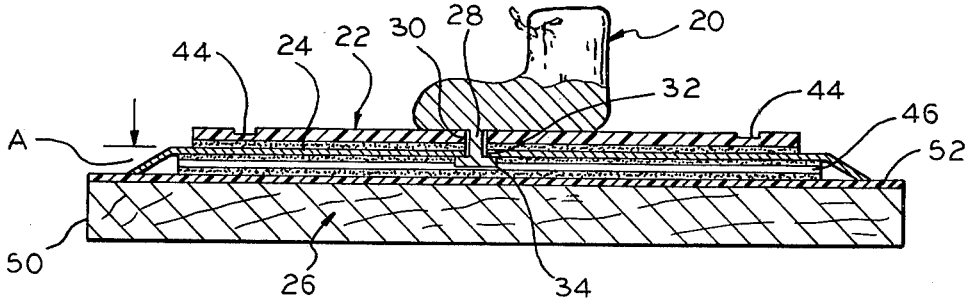
FIG. 2 is a cross-section of the inventive structure taken along line 2—2 of FIG. 1.

The exploded view of FIG. 1 includes a secondary display or finding 20, a debossable plastic sheet 22 bonded to a metal backing plate 24, and a wooden or simulated wood plaque 26, by way of example. The secondary display or finding 20 (here shown as a charm in the exemplary form of baby shoes) or an equivalent thereof may or may not be provided. If it is provided, the finding will preferably include one or more integral stakes 28 that pass through aligned holes 30, 32 in the debossable plastic material 22 and the metal backing plate 24. The bottoms of these stakes may be swagged (as at 34, FIG. 2) in order to anchor the findings to the backing plate 24.

More broadly, the finding 20 represents any secondary display that may be secured to the plaque. The holes 30, 32 may be punched after the debossable plastic material 22 and backing plate 24 are bonded together. Therefore, there are no alignment problems of trying to precisely fit holes 30 over other holes 32 which must be pre-formed in the wooden board 26.

The debossable plastic material 22 includes a thermoplastic plate 36 (FIG. 1) covered on its upper surface by a thin polyester film 38 and on its lower surface by a substrate 40 which prevents a lateral displacement of the thermoplastic material 36 during debossment. The bottom of substrate 40 is covered by a layer of pressure sensitive adhesive 42. Therefore, material 22 may be quickly and easily bonded to the metal backing plate 24 by removing a release paper covering adhesive 42 and pressing material 22 onto plate 24. The upper surface film 38 has a heat insulating quality such that it plays no part in spreading heat during a debossment process. The film 38 is "metalized", which is a term of art describing a layer of metal particles, a few molecules in thickness, covering the film (usually the lower surface of film 38) to give it a brushed metal surface appearance.

A film of hot stamping foil (not shown) is placed over the surface of debossable material 22. Then, a heated die (also not shown) is lowered to deboss the thermoplastic plate 36 while transferring ink from the hot stamping foil into the bottom of the debossment. For example, some of the transferred ink is seen at 44, which gives the visual impression of an engraved metal plate having some form of paint in the bottom of the "engraved" lines.

The materials and processes used to make the material 22 are described in greater detail in U.S. Pat. Nos. 3,940,864, 4,047,996, 4,125,655 and 4,267,224.

The backing plate 24 may take any of several suitable forms. Although it is not necessary to do so, the backing plate is generally a metal sheet formed in a coining die. As those skilled in the art know, a coining die is one which completely confines all sides of a piece of metal while it is being stamped, pressed, and compacted into a desired shape. Preferably, the entire perimeter of plate 24 is formed to have a bevel, at an angle A (FIG. 2), of a few degrees. The upper surface of at least this bevel is preferably given a bright polish. It is the same kind of metal and the same color that appears on the metalized surface of upper film 38. When the debossable material 22 is bonded to the backing plate 24, the two bonded layers 22, 24 appear to be a single piece of metal. Thus, when the debossable material 22 is hot stamped, as described above, it gives an appearance of a single metal plate having engraving on a brushed surface, framed by a brightly polished beveled edge.

The rigidity of the metal backing plate 24 provides enough mechanical strength to support secondary displays such as findings 20, other plates 24B, or the like. Therefore, it is easy to attach and handle all of the parts which may be mounted on the plaque, at this stage in the manufacturing (i.e., when material 22 and plate 24 are simply bonded together).

Two or more flexible strips 46, 48, having double sided adhesive, are attached to the back of the metal backing plate 24 and then pressed into position on the top of the plaque 26. Thus, the total combination becomes a single integrated part.

Plaque board 26 may take any suitable form such as a solid piece of walnut wood, or the like, for example. Or, the board 26 may be made, as disclosed in my U.S. Pat. No. 4,125,655, where a particle board 50 is formed with painted edges and covered with a vinyl layer 52 having a simulated wooden grain. Preferably, the surface area of plaque board 26 is sufficiently larger than the surface area of metal backing plate 24 so that the wood completely surrounds and frames the metal plate.

These inventive features may find different uses, an exemplary few of which are seen in FIG. 3–10. These figures use the same reference numerals, with a letter suffix, to identify similar parts, so that they will not have to be described repeatedly.

Figure 3:
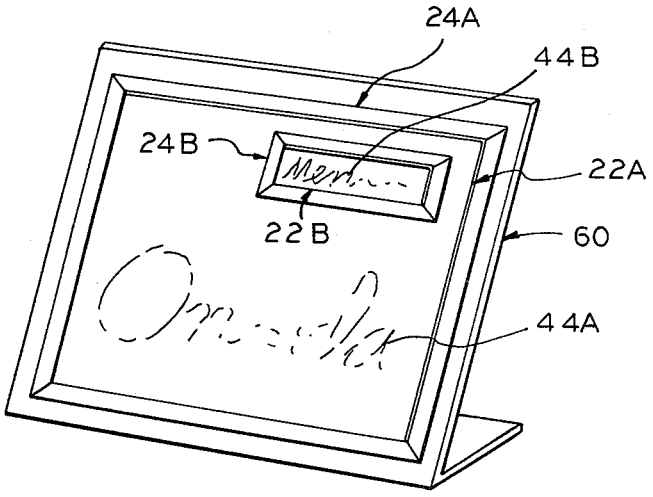
FIG. 3 illustrates the use of multiple plaques, here used in connection with an exemplary self-supporting metal, for example, stand.

In FIG. 3, there are two of the inventive plaques, each comprising debossable material (22A, 22B) bonded to a metal backing plate (24A, 24B). In this particular example, the "engraving" 44A is assumed to be a brand name of a well known manufacturer. The engraving 44B on the secondary display 22B is assumed to be the name of an individual retailer who is selling the manufacturer's product. Thus, the manufacturer may secure hundreds of identical plaques 22A which advertise its brand of product. Each of these plaques 22A may then be customized with the secondary display 44B carrying the individual names of the retailers, who sell the product. Of course, there are many other and different reasons for mounting one or more plaques in this manner.

The secondary display plaque 22B could be riveted to the plaque 22A, much as finding 20 (FIG. 2) is riveted to the plaque formed by material 22 bonded to metal backing plate 24. However, a double sided adhesive tape is preferred, as shown at 46, 48 in FIG. 1. Regardless of how the plaques 22A, 22B are assembled, the metal backing plate 24A is next attached to a suitable stand 60, which could be metal, plastic wood, or the like.

In one embodiment, the metal stand 60 was stainless steel with a brushed surface appearance. The metal backing plates 24A, 24B had a generally silver look of polished sterling. The debossable material 22A, 22B had the appearance of brushed silver. The "engraving" at 44A appeared to be polished silver against the brushed silver background, while the "engraving" at 44B had the appearance of black enamel. The overall effect was one of a plate engraved by polished silver lettering, set on a brushed silver background, and enhanced by the stainless steel of stand 60.

Figure 4:
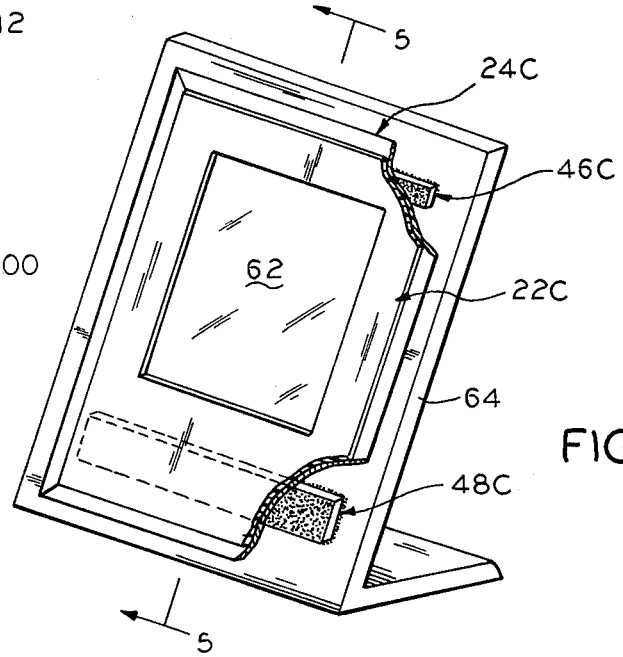
FIG. 4 is a use of the inventive plaque material as a part of a self-aligning picture stand made of any suitable material.

In FIG. 4, the debossable material 22C and metal backing plate 24C have a window 62 which is die cut therein, to form a picture frame. (This particular embodiment is a modification of the frame shown in my co-pending application, Ser. No. 209,753, filed Nov. 24, 1980.) In this particular case, the stand is here described (by way of example only) as a relatively thick sheet of transparent plastic, such as "Lucite" acrylic, which may be clear, smokey, colored, or the like. The lower region of the metal backing plate 24C is attached to stand 64 by double sided adhesive strip 48C. This same strip also provides a fixed ledge for receiving and positioning a picture or other graphic material 70 (FIG. 5) to be displayed through the picture area 62 in the frame of debossable material 22C.

My above identified application Ser. No. 209,753, includes details about a transparent folder or envelope 72 having target areas printed thereon which may be used to center the graphic display, when it is resting on the ledge formed by the double sided tape 48C. The target area printed on sheet 72 is a rectangle, in this example. The rectangle is slightly larger than the window 62 so that a picture centered in the rectangle is also centered in window 62, but the printed rectangle is outside of window 62 and concealed behind plastic material 22C.

Figure 5:
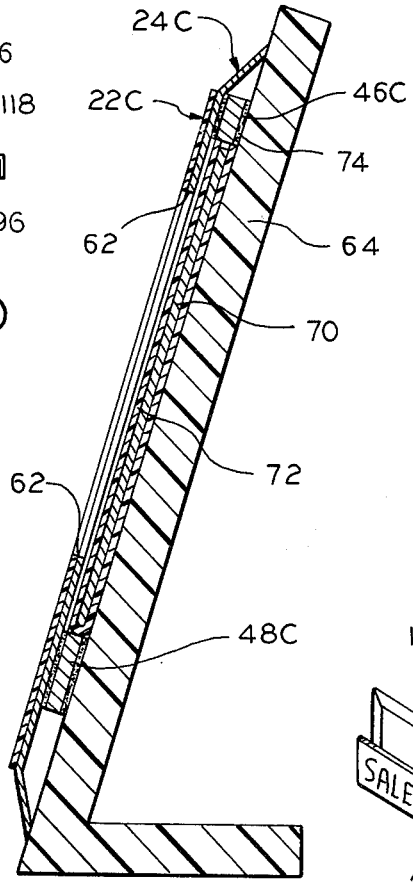
FIG. 5 is a cross-section taken along line 5—5 of FIG. 4.

A first and preferred way to make the embodiment of FIGS. 4 and 5 is to assemble the coined metal backing plate 24C, debossable material 22C, transparent folder 72 and graphic display 70 into a packet, while they are separate from the stand 64. This way, the picture or graphic material 70 may be trimmed, centered, and in any other way assembled or reassembled into the best and most attractive packet form, at a time when it is easy to manipulate the parts.

Then, the double sided tape 46C, 48C may be used to attach the graphics behind the plate while viewing the graphics through window 62, thereby assuring a proper alignment. This forms a self-contained packet which may be attached as a unit to the stand 64.

This preferred pre-assembly procedure enables a more precise alignment of the packet and, perhaps, a more artistic arrangement than would be easily possible if it were necessary to side the graphic display behind a preattached frame.

The frame of FIGS. 4, 5 may also be sold with the entire unit in place on stand 64 and with a piece of release paper 74 over the rear adhesive surface of upper tape 46C. The preattched assembly of debossable material 22C and metal backing plate 24C may be slightly flexed forward and away from the stand 64 far enough for the picture or other graphic material 70 to be slipped in place behind the backing plate 24C and rested on lower tape 48C which anchors the plate 24C to the stand. At the same time, the release paper 74 is peeled away. Then, the backing plate 24C is released to flex back into contact with stand 64. A bit of pressure on material 22C, in front of the tape 46C presses it against stand 64 and the entire unit is secured with a picture captured in the frame.

Figure 6:
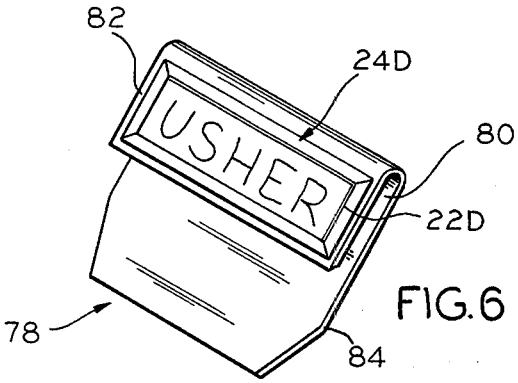
FIG. 6 is a perspective view of the invention used in connection with a name badge on a U-shaped backing plate to be worn in a breast pocket.

FIG. 6 shows a name badge use for the invention. Here, a plate of material 78 (stainless steel or polished brass, for example), which is no wider than a breast pocket, has a fold to form a generally U-shaped bight, at 80. The lower or free end of this plate forms a tab 84 which may slip into a breast pocket with the upper U-shaped section 82 hanging over the upper edge of the pocket. One of the inventive assemblies of debossable material 22D bonded to a metal backing plate 24 is bonded to the exposed part 82 of plate 78, in a position which is displayed when the tab is slipped into position in a breast pocket. When in position in a pocket, only the front plate 82 and display 22D, 24D are visible.

Figure 7:
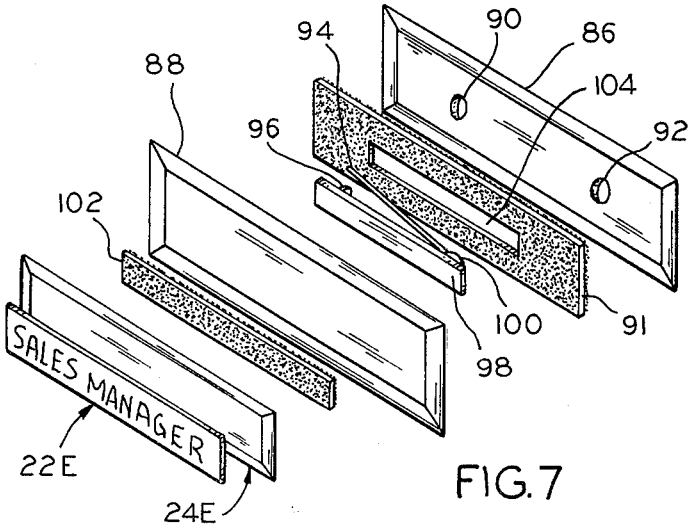
FIG. 7 is an exploded view of the invention used on a different form of a name badge with a pin back.

Still another exemplary use of the invention is the name badge seen in FIG. 7. Here, two of the metal backing plates 86, 88 are placed in face to face alignment and cemented or otherwise joined together to form a single unitary structure. One way of joining the plates 86, 88 is by means of a double sided tape 91, having a window 104 cut therein to receive plate 98 of a conventional pin back. Also, a suitable cement may fill the space between plates 86, 88 and then solidify them into a single unit. The rear one 86 of the backing plates has a pair of spaced apart holes 90, 92 which receive a pin 94 and a clasp 96 of pin backing 98. The pin 94 folds at pivot point 100 and behind plate 86 to engage clasp 96. The pin back 98 is held in place by any suitable means, here, the frictional engagement with window 104 plus the cement, if any, that may be used.

The assembly of debossable material 22E bonded to a metal backing plate 24E are then secured to plate 88 by a double sided adhesive tape 102.

The embodiment of FIG. 6 shows a name badge mounted on a generally rigid piece of metal 78 having a U-shaped bight 80 which rides on the top edge of a pocket. This badge tends to place weight and wear on the pocket edge, and the pressure of the two sides 82, 84 may make the garment material somewhat shiney. Some garments may become crumpled or otherwise damaged while other materials are too weak and lacking in body to support the weight of the FIG. 6 name badge. If the badge of FIG. 7 is used, the pin 94 may leave unsightly holes. If the badge is caught, the pin could tear the garment.

Figure 8:
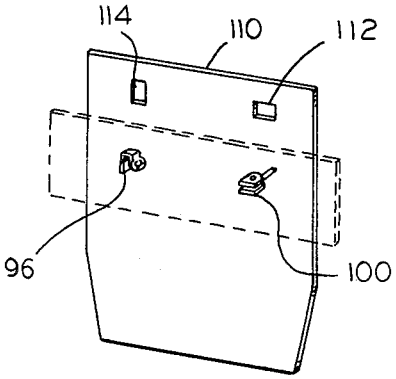
FIG. 8 is a plan view of a flat metal plate which may be attached to a name badge shown in FIG. 7, in order to wear the badge in a breast coat pocket without either requiring pinholes in the garment, or crushing the garment material.

In order to overcome these and other problems, the flat metal pocket plate 110 of FIG. 8 may be used to support the name badge of FIG. 7. In this case, the badge hinge 100 (FIG. 7) and pin 94 slip through a window 112 (FIG. 8) on the flat metal pocket plate 110 and clasp 96 slips through the window 114. The pin type name badge of FIG. 7 is relatively loosely fastened to the metal plate 110 so that it tends to adjust itself and its position to the conditions of garment, tipping up a little for thick material and down over shear material. There is no undue pressure rubbing against the garment material forming the pocket (such as the pressure which may be applied by the two sides 82, 84 of plate 78 owing to the ridigity of the U-shaped bight 80). There are no unsightly pin holes in the garment, and no chance of snagging and tearing the pocket. Moreover, the length of plate 110 may be such that the pin is positioned a little above the edge of the pocket so that no weight is put on the pocket edge.

Figure 9:
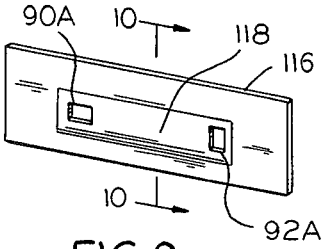
FIG. 9 is a perspective view of an alternative backing plate for use with the pin back name badge of FIG. 7.
Figure 10:
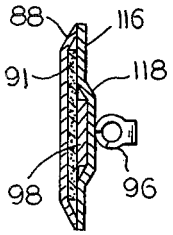
FIG. 10 is a cross-section of the name badge of FIG. 9, taken along line 10—10 thereof.

In some embodiments, the backing plate 86 (FIG. 7) may be replaced by the backing plate 116 of FIGS. 9, 10. The plate 116 has a debossed area 118 which more or less exactly fits the pin back 98, and therefore, helps to align it. The debossment eliminates the need for the step of forming an opening 104 (FIG. 7) for receiving and aligning the pin back 98. Also, as best seen in FIG. 10, the debossed area 118 enables the pin to stand out from and better project behind the pin back 116. This clearance tends to make it a little easier to attach the name badge to clothing or the like.

These are only an exemplary few of many different uses for the inventive assembly. Those who are skilled in the art will readily perceive how to modify the invention. Therefore, the appended claims are to be construed to cover all equivalent structures which fall within the true scope and spirit of the invention.

I claim:

1. A plaque simulating an engraved metal plate comprising a metal backing plate of a given metallic color having a planar surface terminated at its periphery in a generally decorative framing surface area which preserves the look of an edge of a metal plate, debossable plastic material bonded to said backing plate, said plastic material comprising a rigid thermoplastic plate covered by a thin heat insulating film of essentially said given metallic color, said film following and containing a debossment of said thermoplastic plate when debossed under heat and pressure, the edges of said debossable material coordinating with the metallic color of said framing surface area to give an overall appearance of a single and unitary metal plate having an engraved surface formed by said debossment.

2. The plaque of claim 1 wherein said film is a metalized polyester material in the metallic color, said decorative framing surface has a bevel surface with polished reflectivity.

3. The plaque of claim 2 and means for supporting said backing plate with a surface display surrounding and framing said backing plate.

4. The plaque of claim 3 wherein the surface display of said support means has a wooden appearance.

5. The plaque of claim 3 wherein the surface display of said support has a metallic appearance.

6. The plaque of claim 3 wherein the surface display of said support means has a transparent appearance.

7. The plaque of any one of the claims 1–6 and secondary display means mounted on the debossable material bonded to said backing plate.

8. The plaque of claim 7 wherein said secondary display is a finding.

9. The plaque of claim 7 wherein there are a plurality of assemblies of said plaques formed by said debossable material bonded to a backing plate, the secondary display being at least one of said plaque assemblies mounted on the surface of another of said plaque assemblies.

10. The plaque of any one of the claims 1–6 wherein the plaque includes said backing plate mounted on a wooden panel to form a board-like type of display.

11. The plaque of any one of the claims 1–6 wherein the plaque is an assembly including said backing plate mounted on stand means for substantially vertical display.

12. The plaque of any one of the claims 1–6 wherein the plaque is an assembly including said backing plate mounted on means for attachment to clothing.

13. The plaque of claim 12 wherein said attachment means is a pin backing.

14. The plaque of claim 13 and a flat plate of material having a pair of windows positioned so that said pin backing may be attached thereto, said plate of material being shaped and proportioned to fit into a pocket while holding said pin backing above an edge of the pocket.

15. A method of forming a picture in a frame comprising the steps of:

(a) laminating metalized polyester plastic film and a thermoplastic plate, said plate having a heat deformable characteristic such that the thermoplastic material of the plate debosses under localized heat and pressure and said overlying plastic film contains the plastic of the plate during deformation and conforms to said debossments;

(b) hot-stamping said laminate for forming a desired design on said laminate responsive to the application of the heat and pressure that debosses said plastic material;

(c) forming at least a die cut sheet of said laminated plastic material;

(d) said die cut laminate attaching said die cut sheet to a metallic backing plate made of the same kind of metal that is used to metalize said polyester film, said backing plate having polished exposed edges, and backing frame being shaped in a general style and form of a picture frame having a window therein;

(e) aligning a graphic material behind the window;

(f) forming a complete packet of said picture frame and graphic material and;

(g) attaching said packet to a stand.

16. The method of claim 15 and the added step of enclosing said graphic material behind a transparent material having a target area printed thereon to facilitate a centering of said graphic material within said window.

17. A name badge simulating an engraved metal plate comprising a first backing plate having a debossment formed therein with a pair of spaced apart holes on opposite ends of said debossment, a pin back fitting within said debossment and having a clasp and pin fitting through said spaced apart holes, a second backing plate having a planar surface terminated at its periphery in a generally decorative, beveled framing edge, said first and second backing plates coming together and being joined face-to-face to form a single generally convex plate, debossable plastic material bonded to said second backing plate, said plastic material comprising a thermoplastic plate covered by a thin heat insulating film, said film following and containing a debossment of said thermoplastic plate when debossed under heat and pressure, the edges of said debossable material being coordinated with the color of said beveled framing edge to give an overall appearance of a single metal plate.

18. The name badge of claim 17 and a flat metal pocket plate having windows formed therein to receive said clasp and pin whereby said name badge may be pinned to said pocket plate.

* * * * *